US005589659A

United States Patent [19]

Kustermann et al.

[11] Patent Number: 5,589,659

[45] Date of Patent: Dec. 31, 1996

[54] CONTROL OVER EXCESS COATING COMPOSITION IN COATING DEVICE FOR TRAVELING PAPER WEB

[75] Inventors: Martin Kustermann, Heidenheim; Ingo Gottwald, Steinheim; Manfred Ueberschár, Nattheim, all of Germany

[73] Assignee: J.M. Voith GmbH, Germany

[21] Appl. No.: 119,963

[22] Filed: Sep. 10, 1993

[30] Foreign Application Priority Data

Sep. 10, 1992 [DE] Germany ..... 42 30 276.5

[51] Int. Cl.[6] ..... B05C 3/02

[52] U.S. Cl. ..... 118/413; 118/419; 118/410

[58] Field of Search ..... 118/410, 413, 118/414, 411, 419, 261; 427/356

[56] References Cited

U.S. PATENT DOCUMENTS

| | | | |
|---|---|---|---|
| 4,688,516 | 8/1987 | Sommer | 118/410 |
| 4,757,782 | 7/1988 | Pullinen | 118/410 |

*Primary Examiner*—Brenda A. Lamb
*Attorney, Agent, or Firm*—Ostrolenk, Faber, Gerb & Soffen, LLP

[57] ABSTRACT

A device for predosing coating composition on a traveling web of paper. A guide member extends obliquely toward the web. Downstream in the path of the web past the guide member, a doctor element is supported spaced from the tip of the guide member for defining a pressure space between the a guide member and the doctor element. Coating composition is fed through a feed channel between the guide member, on the one hand, and the doctor element and the supports for the doctor element up to the pressure space, on the other hand. An exit slot from the pressure space between the guide member and the web is defined at the tip of the guide member. The guide member has a guide surface down from the tip of the guide member, on the side of the guide member away from the doctor element which faces generally toward the web. The guide surface defines a return channel for coating composition that has moved out of the pressure space and through the slot. The guide surface is gradually inclined so that the return channel gradually enlarges away from the tip of the guide member and the return channel serves as a pressure reduction space for the excess coating composition. The doctor element may be in the form of a doctor bar or a coating blade with an angle of application against the web of at most 20°.

22 Claims, 3 Drawing Sheets

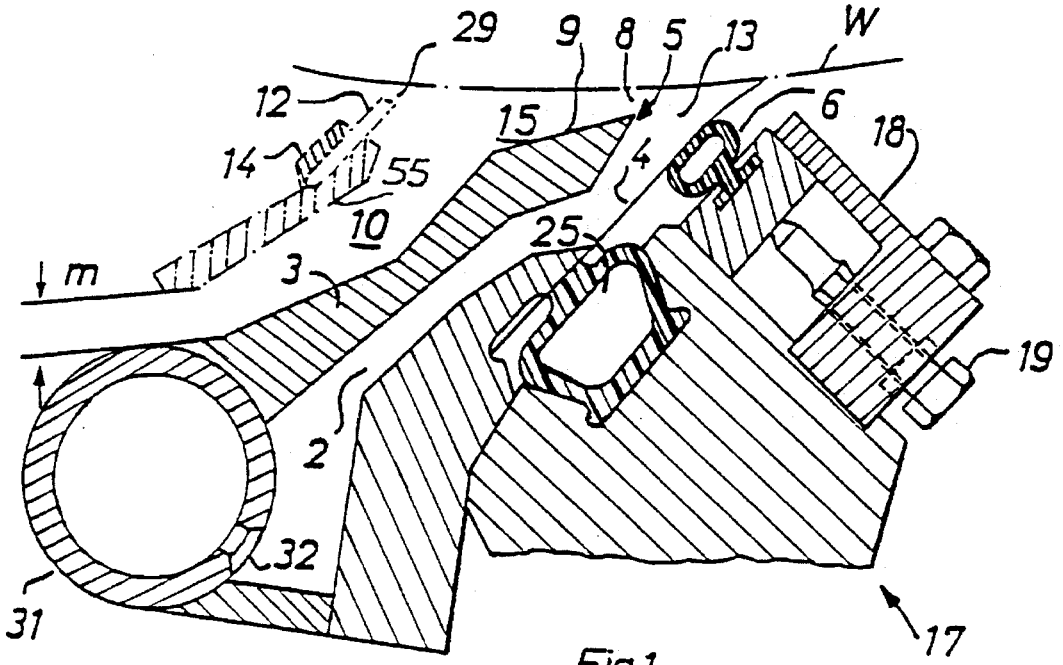
Fig.1
Fig. 2a
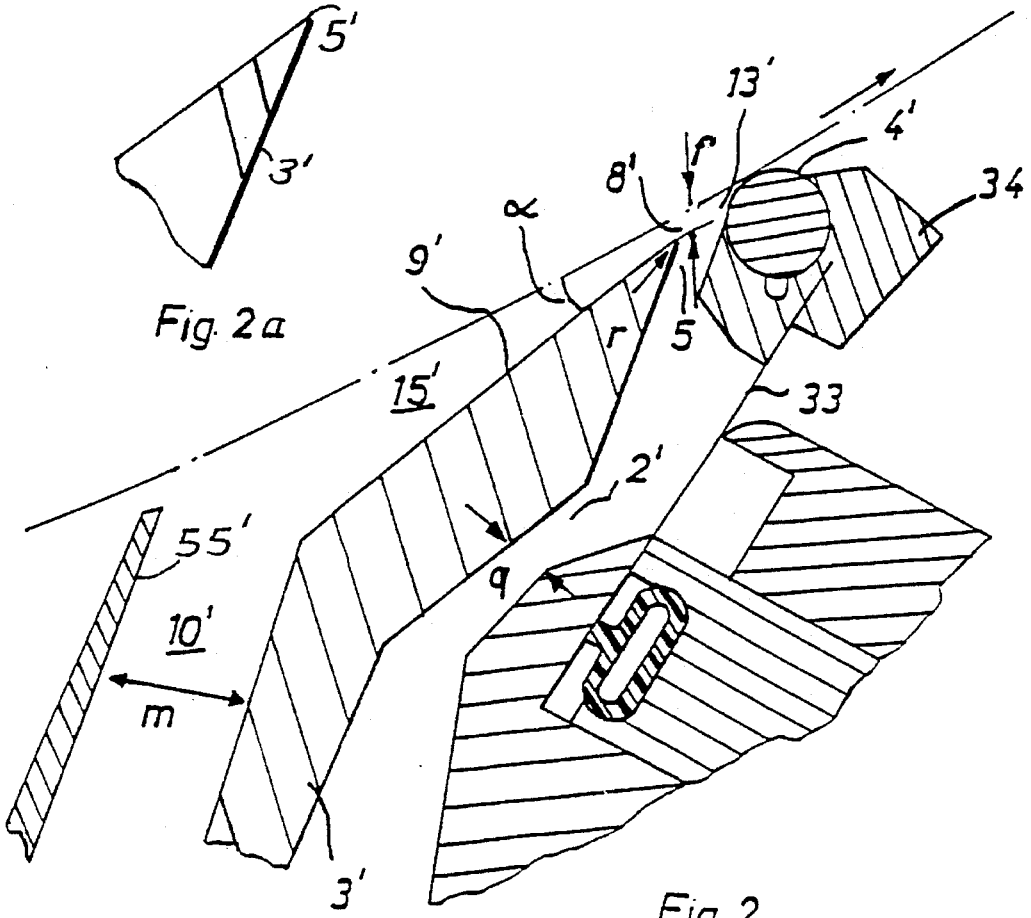
Fig. 2

Fig. 6
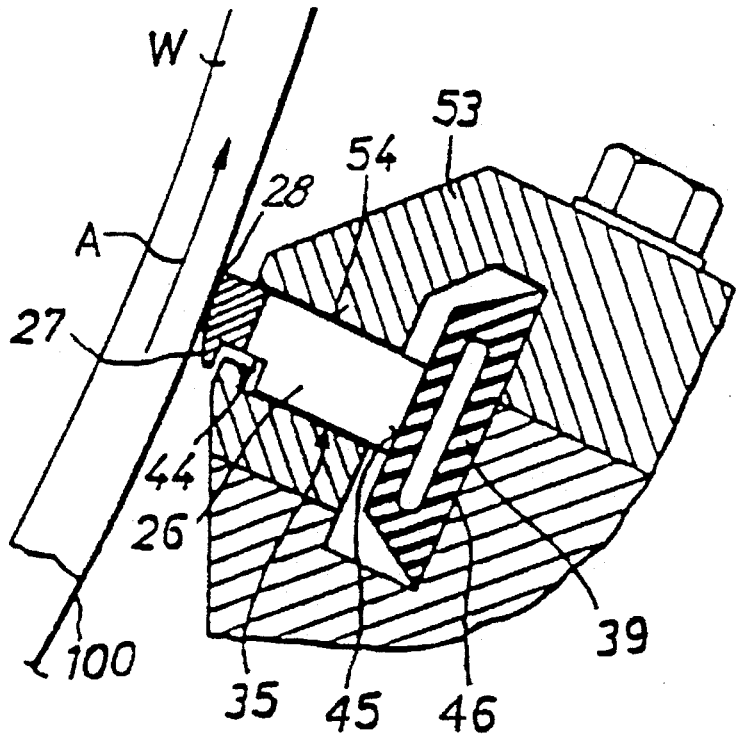
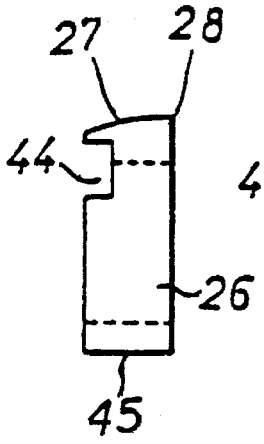
Fig. 7a
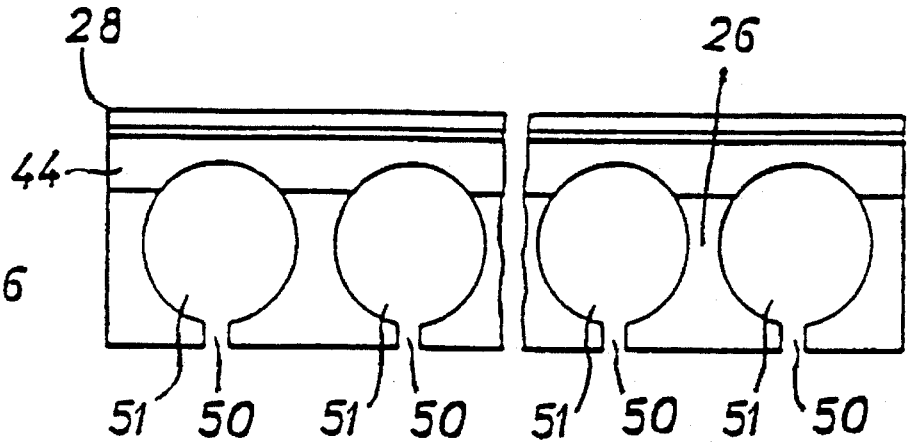
Fig. 7

CONTROL OVER EXCESS COATING COMPOSITION IN COATING DEVICE FOR TRAVELING PAPER WEB

BACKGROUND OF THE INVENTION

The present invention relates to a coating device for a paper or board web, and particularly to a guide for the discharge of coating that overflows from the coating application chamber of the device.

A coating device of the type with which the invention may be used is known from Federal Republic of Germany Utility Model 91 06 311. Coating material is flowed from a source against a web moving past an application chamber that is typically pressurized. That coating device includes a guide member which forms a slot for the passage of discharging coating material. The slot is located at the web of material at the place where the web is being guided past the slot by a backing roll. The slot is of substantially constant width off the web and has a relatively long length in the direction of travel of the web. A coating material exit channel or discharge channel is provided at the web entrance end of this slot, because in this device, the web is moving counter to the discharging coating material flow. A feed channel for the coating is provided on the other end of the slot where the doctor element is located. In the discharge channel, i.e. at the start of the slot, there is a throttle plate which forms a throttle slot for regulating the discharge of excess coating composition on the web of material. Very large excess quantities of coating material are required here, as compared with the weight of coating remaining on the web, in the event that this device is used as a predosing device, due to the relatively large slot.

Ordinary dip rolls are also known for use as predosing devices which apply excessive coating composition in a transfer slot to the web of material at the place where the web is guided by a backing roll. However, relatively large problems may arise with higher web speeds, particularly in or at the transfer slot.

SUMMARY OF THE INVENTION

The object of the present invention is to provide a predosing device for a web coating which operates with as few problems as possible, even at higher web speeds.

This object is achieved in accordance with the invention which comprises a device for predosing coating composition on a traveling web of paper. A guide member extends obliquely toward the web. Downstream in the path of the web past the guide member, a doctor element is supported spaced from the tip of the guide member for defining a pressure space between the guide member and the doctor element. Coating composition is fed through a feed channel between the guide member, on the one hand, and the doctor element and the supports for the doctor element, on the other hand, up to the pressure space. An exit slot from the pressure space is defined between the tip of the guide member and the web.

The guide member has a guide surface down from the tip of the guide member, on the side of the guide member away from the doctor element which faces generally toward the web. The guide surfaces define a return channel for coating composition that has moved out of the pressure space and through the slot. The guide surface is gradually inclined so that the return channel gradually enlarges away from the tip of the guide member and the return channel serves as a pressure reduction space for the excess coating composition.

The doctor element may be in the form of a doctor bar or a coating blade with an angle of application against the web of at most 20°.

Excess coating composition must be present in considerable quantity in the slot provided at the start of the return channel which produces a closed pressure space at the web and the doctor element, so that suitable conditions with clear discharge relationships exist. A discharge channel for the excess coating composition can be provided at the discharge end of the return channel. This discharge channel has a relatively large cross section so that the excess coating composition flows off easily.

The guide surface, which faces the web, of the guide body may be developed flat without steps. It extends at an angle of between 0° and 20° to the tangent to the web which is drawn to the web from the point of the slot, or on the other hand, the return channel widens by at least 3 mm in the direction of flow of the excess composition, i.e. in the direction away from the doctor element, for every 40 mm of slot length, measured counter to the direction of travel of the web. The maximum widening of the return channel is about 30 mm. Preferably, there is a maximum slot width of 6 mm at the start of the guide surface of the guide member forming the slot in order to get along with a reasonably dimensioned pump output and a suitably large, preferably relatively small excess of coating material.

Other features and advantages of the present invention will become apparent from the following description of the invention which refers to the accompanying drawings.

BRIEF DESCRIPTION OF THE DRAWINGS

FIGS. 1 and 2 are cross sections through predosing devices of the invention for coating devices and showing two embodiments of flow bodies; FIG. 2*a* is a greatly enlarged view of a portion of FIG. 2 showing the edge of a guide member;

FIG. 6 is a diagrammatic partial view in section of a doctor ledge for the device in accordance with FIG. 1; and FIGS. 7 and 7*a* are a side view and bottom view respectively of the doctor ledge of FIG. 6.

DETAILED DESCRIPTION OF THE INVENTION

Figure 3:
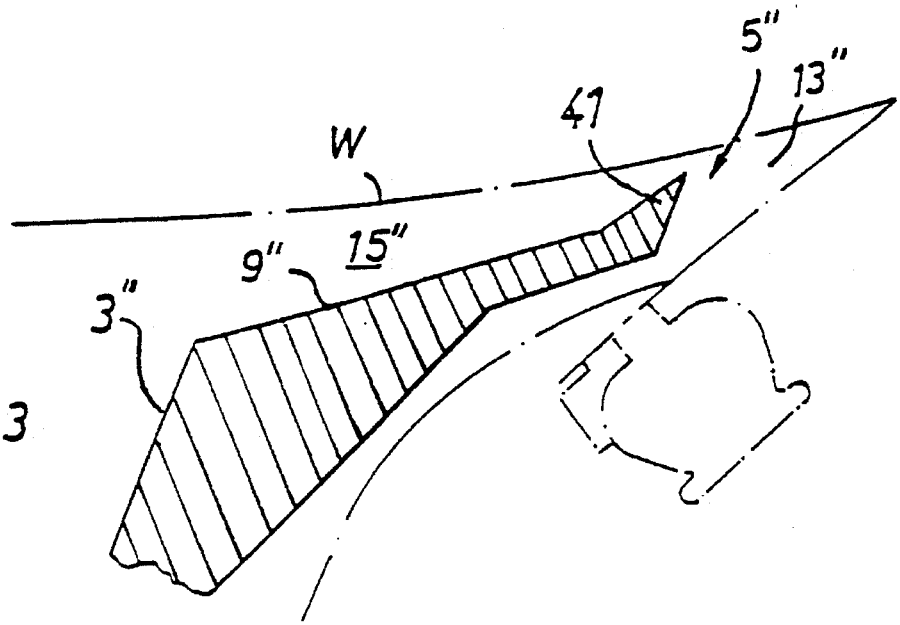
FIGS. 3 to 5 show cross sections through three other flow body embodiments of the invention useful with the predosing device.

The cross sections of FIGS. 1–5 are all taken perpendicular to the backing roll, which in this case guides the web w, i.e. the cross sections are taken parallel to the direction of travel of the web. Nearly all of the parts shown in section extend along the axis of the roll over the full width of the paper web and the full length of the roll. This provides the channels and slots with the proper width, i.e. machine width, which is generally between 5 and 9 m.

FIG. 1 shows a predosing device for a coater for a web w carried on a backing roll. The device includes a guide member 3 which extends generally obliquely toward the web. A doctor element 4 which in FIG. 1 is developed as a coating blade, also extends to the web at a location spaced downstream in the web path from the guide member 3. The member 3 defines a feed channel 2 for coating composition at its underside, which is the side of the member 3 that faces the doctor element 4. The remainder of the channel 2 is defined by strip shaped or beam shaped support devices for the doctor element.

The guide member 3 also defines a return channel 15 for the excess coating composition on the web w by its guide surface 9 on the top side of the guide member. The coating composition flows up out of the channel 2, past the narrow slot 8 defined at the tip or edge of the guide member 3, which tip is the closest approach of the guide member to the web, and into the channel 15. The channel 15 is of the length of the guide surface 9, up to the sharp downward incline of the guide member. With a guide surface 9 without projections, for instance as shown in FIG. 1, the angle of inclination $\alpha$ between the guide surface 9 and the web w is between 4° and 8°. In other embodiments, this angle may be between 4° and 30°; at the transition between the feed channel 2 and the return channel 15 a pressure space 13 is produced which space is also in the vicinity of and extends to the dosing edge of the doctor element 4.

The doctor element 4 is a stiff but flexible blade, which extends to the web and is clamped fast in its mount by a pressure hose 25. The element 4 is pressed against the backing roll and the paper web thereon by another pressure hose 6. The position of the doctor element can also be regulated by a setting member 18 by means of a setting screw 19. There are individual ledges of beam-shaped parts of the mount which form a support device 17 for the coating means.

There is a feed pipe 31 with outlet openings 32 for coating composition. The openings are distributed along the width of the machine, i.e. over the length of the roll.

At the outlet end of the return channel 15 beyond the end of the guide surface 9, there is possibly present, as indicated here in dash-dot line, a discharge 10 channel 10 for the excess coating composition the discharge channel 10 being defined between the guide member 3 and a support wall 55 of the support device 17. There may be a further discharge slot 29 for a smaller amount of excess coating composition which is formed at the overflow edge of a barrier ledge 12. The ledge 12 is held by a holding ledge 14 on the support wall 55 of the support device 17. An air-barrier, which can act like the ledge 12, is also favorable. The barrier ledge 12 is preferably spaced in the range of 25 to 50 mm from the outlet end of the return channel 15.

The width m of the discharge channel 10 (FIG. 1) or 10' (see FIG. 2) must be relatively large, amounting to at least 1.7 times the minimum width of the feed channel 2 or 2'. Practically no pressure should prevail in the channel 10 or 10' i.e. no back pressure on the exiting excess coating. Preferably, the width M is in the range between 12 and 30 mm.

The doctor element coating blade 4 is shown here as a so called bent blade, in which the angle of application between the part of the blade present on the dosaging edge and the web of material is at most 20°. In this way, relatively large amounts of coating composition can be applied.

In FIG. 2, practically the same arrangement as in FIG. 1 is shown. The guide surface 9' of the guide member 3' has a somewhat greater inclination of, in this case, 7° to the tangent drawn to the backing roll W at the narrowest width of the return channel 15'. In this case, a roller doctor 4' supported by a plastic bed 34 is used as the doctor element. The roller can have either a smooth surface or a surface provided with circumferential grooves. The plastic bed 34 is held by a coating blade leaf spring 33.

At the entrance to the return channel 15', at its narrowest region and therefore at the slot 8', there is a relatively sharply angled edge 5' of the guide member 3'. As shown in FIG. 2*a*, a tip or edge 5' is round with having a small rounding radius of between 0.8 and 10 mm. A corresponding rounded edge 5 also is found in FIG. 1 on the guide body 3 at the slot 8.

The width of the slot 8, 8', 8", etc. between the tip edge of the guide member and the web is preferably in the range of 1 to 6 mm.

The distance between the angular edge 5' of small rounding radius and the dosing line of the roller doctor 4', (or the dosing edge, for instance with a coating blade) is at most 35 mm. In the case of FIG. 1, this value applies approximately when correspondingly referred to the distance from the angular edge 5 to the pressure line of the pressure element 6 on the coating blade 4. The corresponding distance to the coating edge of the blade 4 is at most 85 mm.

The length of the guide surface 9 or 9' and therefore of the return channel 15 or 15', measured as a projection thereof onto the web of material or the backing roll is at least 50 mm and is generally at most 90 mm.

The guide member 3" in FIG. 3 is provided on the top side thereof having the guide surface 9" with a tip in the region of the angular edge 5" having a small rounding radius. It also includes an entrance part 41 of the guide surface which is inclined by about 25° to 30° to the tangent drawn on the slot to the backing roll. This angle can rise gradually, or can rise suddenly in several steps, to be greater than the angle of inclination to this tangent of the other part of the outlet region of the guide surface 9", of between 0° and about 10° to said high values. The configuration of FIG. 3 is advantageous for most coating compositions.

Figure 4:
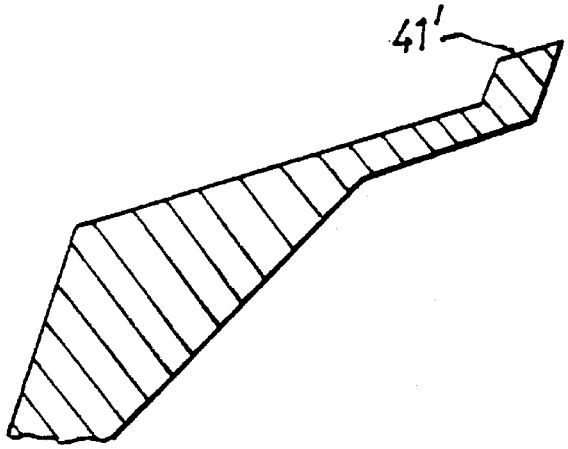

A similar guide member is shown in FIG. 4. However, the tip of the projection 41' on the guide surface is not so pronounced as in FIG. 3.

The rounding radius of the angular edge 5, 5", etc. need not be precisely a radius. It can be replaced by a polygonal path and with respect to the entire guide body, by flat surfaces arranged one behind the other in the form of a polygon as in the case of a prism. This is simpler in most cases from a manufacturing standpoint. Providing substantially too small a radius, one substantially smaller than the lower limit value indicated, could lead to too high a pumping power or to a failure of the device in a considerable number of cases of use, particularly in the event of a very small slot at this place.

Figure 5:
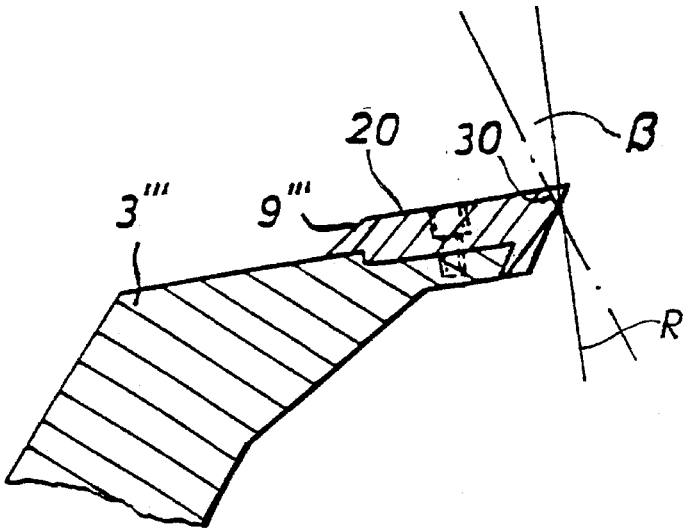

FIG. 5 shows a guide member 3''' having an attachment part 9''' which represents a projection of the guide member. The attachment part defines the guide surface on its top side. In dot-dash line, there is also shown a beveled edge 30 of the attachment part 9'''. The length of the bevel is at most 18 mm and it is inclined at most at an angle $\beta$ of about 35° with respect to the radial direction, with reference to the web conducting backing roll. This angle is at least 0°.

The dimensions indicated provide a pressure reduction space 15, 15' or 15" which reduces the pressure of the coating composition prevailing in the pressure space 13, 13' or 13" to atmospheric pressure or slightly above that in a manner such that a very uniform application of coating is possible even with very high web speeds of more than 1300 m/min. It is particularly important that the excess coating composition passes through the return channel or pressure reduction space in the direction opposite the direction of travel of the web of material.

The invention also has the advantage that the ordinary predosing device can be replaced by an applicator roller, with resulting considerable savings. It has been found that a substantially smaller total amount of circulating excess coating composition is necessary. Furthermore, the predosed amount of coating composition initially remaining on the web, which is about 50 to 80 ml/m$^2$ of liquid, is also substantially less than the amount of about 200 ml/m$^2$ of liquid which is customary with a roller applicator. This corresponds to a coating thickness solids content of about 9 g/m$^2$ per side with a weight of paper of 42 g/m$^2$. This leads in all cases to the fact that the dosing process to be effected on the final or end dosaging place, formed in general by a coating blade, can be effected substantially more easily in order to obtain a particularly uniform application of the coating.

For the dosing element, instead of the doctor bar 4', one can also use a doctor strip of irregular cross section, which also has an arcuately curved doctor or coating surface (see FIG. 6).

In the device shown in FIG. 6, the web of material 100 to be coated travels in the direction indicated by the arrow A over a support roll W. In a rigid doctor bed 53, a doctor ledge 26 is slidingly guided between parallel slide surfaces 54, 35. The doctor ledge 26 has a convexly curved end surface which is pressed against the coated web 100, and that surface has a sharp edged tear edge 28. Pressure means, in the form of a pressure tube 39 between doctor holder 53 and doctor ledge 26, press the doctor ledge 26 variably and with fine adjustment against the web of material 100 to be coated.

The doctor ledge 26 is freely displaceable in two axes within selectable limits along the parallel slide surfaces 54, 35 of the doctor bed, i.e. it is unimpededly extendible. In the region of the end surface 27 and tear edge 28, referred to an axis perpendicular to the tear edge 28 and parallel to the coated web 100, the doctor ledge has a relatively small moment of plane area I which lies preferably within the range of between 200 mm$^4$ and 7000 mm$^4$. Such a moment of plane area I can, for instance, be obtained in the manner, as shown in FIG. 7, that equidistant cuts 50 and recesses 51 are provided along the length of the doctor ledge 26, while the cross section of the ledge, measured up to a slight distance from the tear edge 28, remains constant over the entire doctor ledge 26. The flexural softness of the doctor ledge 26 thereby obtained can alternatively also be obtained by suitable selection of the material or by a correspondingly slight height of the doctor ledge 26.

The end surface 27 of the doctor ledge 26 extends at the tear edge 28 approximately tangentially to the coated web 100. In the preferred embodiments shown, the end surface 27 has, at least in the region of the tear edge 28, extending from it, a curvature with a radius of curvature R in the range of between 4 mm and infinity and preferably in the range between 5 mm and 250 mm, and preferably between 20 mm and 50 mm, in order to form a narrowing application slot. The curvature is selected as a function of the desired range of application weight and rheological properties of the fluid applied.

The doctor ledge 26, furthermore, has, at least in the region of the curved end surface 27, a surface having a Vickers hardness of more than 600 HV in order to obtain a high resistance to wear of the end surface 27.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for the predosing of coating composition on a web of material traveling past the device along a path of travel in a predetermined direction of travel, comprising a doctor element;

a coating material guide member having a first side, an opposite second side and a tip, the guide member being structured and arranged to extend from a location away from the web toward the web such that the first side faces generally toward the web, the opposite second side generally faces away from the web and the tip of the guide member extends generally parallel to the doctor element across the web for defining a slot between the tip of the guide member and the web;

means for supporting the doctor element in engagement with the web at a location along the path of travel of the web; the guide member being spaced from the doctor element with the means supporting the doctor element for defining a feed channel for coating composition between the doctor element and the opposite second side of the guide member;

means for feeding the coating composition along the feed channel and toward the web; the means for feeding coating composition and the distance between the tip of the guide member and the doctor element being coordinated to define a pressure space for the coating composition between the opposite second side of the guide member and the doctor element;

the first side of the guide member being so shaped and oriented as to define a return channel and a discharge channel for excess coating composition which has moved out of the pressure space past the slot at the tip of the guide member and over the first side of the guide member, the discharge channel being defined between the first side of the guide member and a support member, and the first side of the guide member and the discharge channel being so shaped as to define a pressure reduction space for the excess coating composition in which substantially no back pressure is extended on the excess coating composition, the width of the discharge channel being at least 1.7 times the minimum width of the feed channel.

2. The device of claim 1, wherein the doctor element comprises a doctor bar.

3. The device of claim 1, wherein the doctor element comprises a doctor ledge having a rounded, convexly curved doctor surface, and the support means for the doctor element urging the doctor surface against the web.

4. The device of claim 1, wherein the doctor element comprises a coating blade adapted to engage the web of an angle of application against the web of at most 20°.

5. The device of claim 1, wherein the guide member is structured and arranged to extend toward the web such that the slot between the tip of the guide member and the web has a width in the range between 1 and 6 mm.

6. The device of claim 5, wherein the first side of the guide member is so shaped and of such length that the return channel has a length of at least 50 mm and at most 90 mm.

7. The device of claim 1 further comprising the web, wherein the first side of the guide member is so shaped and of such length that the return channel defined between the first side of the guide surface and the web has a length of at least 50 mm and at most 90 mm.

8. The device of claim 1, wherein the first side of the guide member defines an initial region of the return channel down from the tip of the guide member and, at the initial region, the first side of the guide member extends at an angle with respect to a tangent to the web at the slot between 4° and 30°.

9. The device of claim 1, wherein the cross section of the return channel is developed with at least one sudden increase, in size in a direction opposite the direction of travel of the web, at a location remote from the slot.

10. The device of claim 1, wherein the first side of the guide is developed with at least one step to enlarge the cross section of the return channel at a region remote from the slot.

11. The device of claim 9, wherein the width of the return channel between the web and the guide surface is in the range between 12 and 30 mm.

12. The device of claim 11, wherein the first side of the guide member is of a length that the return channel has a length of at least 50 mm and at most 90 mm.

13. The device of claim 9, wherein the first side of the guide member is of a length that the return channel has a length of at least 50 mm and at most 90 mm.

14. The device of claim 1, wherein the cross section of the feed channel decreases gradually in a direction toward the pressure space.

15. The device of claim 14, wherein the feed channel includes regions therealong of respective constant cross sections.

16. The device of claim 1, wherein the tip of the guide member is round with a radius of between 0.8 and 10 mm.

17. The device of claim 1, wherein the tip of the guide member is polygonal.

18. The device of claim 1, wherein the doctor element has a dosing edge and the distance from the tip of the guide member to the dosing edge of the doctor element is at most 35 mm.

19. The device of claim 4, wherein the coating blade has an end in engagement with the web and the blade is so placed that the distance from the tip of the guide member to the end of the blade is at most 85 mm.

20. The device of claim 9, wherein the first side of the guide member is so oriented with respect to the web that the return channel widens, in the direction away from the tip of the guide member to the opposite outlet end of the return channel, to at most 30 mm in width.

21. The device of claim 9, further comprising an attachment part on the guide member and the attachment part including a surface which defines the first side of the guide member, and the attachment part further having the tip of the guide member defined thereon.

22. The device of claim 1, further comprising a barrier ledge upstream in the direction of travel of the web from the guide member, the return channel having an outlet end and the barrier ledge being spaced in the range of 25 to 50 mm from the outlet end of the return channel.

* * * * *